US007285015B2

(12) United States Patent
Helbok et al.

(10) Patent No.: US 7,285,015 B2
(45) Date of Patent: Oct. 23, 2007

(54) MULTICONDUCTOR FLAT RIBBON CABLE PLUG CONNECTOR

(75) Inventors: Richard Helbok, Rankweil-Brederis (AT); Martin Kopf, Koblach (AT); Marcel Perle, Feldkirch (AT)

(73) Assignee: Hirschmann Automotive GmbH, Rankweil/Brederis (AT)

( * ) Notice: Subject to any disclaimer, the term of this patent is extended or adjusted under 35 U.S.C. 154(b) by 0 days.

(21) Appl. No.: 11/385,031

(22) Filed: Mar. 20, 2006

(65) Prior Publication Data

US 2006/0246779 A1 Nov. 2, 2006

(30) Foreign Application Priority Data

Mar. 19, 2005 (DE) ..... 10 2005 012 793
Mar. 20, 2006 (DE) ..... 10 2006 013 125

(51) Int. Cl.
*H01R 13/58* (2006.01)

(52) U.S. Cl. ..... 439/606; 439/499

(58) Field of Classification Search ..... 439/606, 439/492, 499, 736, 498, 494
See application file for complete search history.

(56) References Cited

U.S. PATENT DOCUMENTS 4,946,390 A * 8/1990 Smyers ..... 439/404
6,190,196 B1 * 2/2001 Kato ..... 439/493

FOREIGN PATENT DOCUMENTS

| | | |
|---|---|---|
| DE | 295 19 589 | 4/1997 |
| DE | 103 57 275 | 7/2004 |
| EP | 1 317 026 | 6/2003 |

* cited by examiner

*Primary Examiner*—Tho D. Ta
*Assistant Examiner*—Vanessa Girardi
(74) *Attorney, Agent, or Firm*—Andrew Wilford

(57) ABSTRACT

A connector has a longitudinally rearwardly open housing having a forwardly open contact chamber. A flat multiconductor cable projects longitudinally forward in the housing into the contact chamber and is connected there to respective contacts. A spacer extends longitudinally forward into the housing adjacent the ribbon cable and projects longitudinally rearward from the housing. This spacer is formed with at least one transversely extending recess open inside the housing toward the ribbon cable. A molded synthetic-resin mass engaged around the cable immediately rearward of the housing fills the recess and bears transversely outward against the cable.

9 Claims, 5 Drawing Sheets

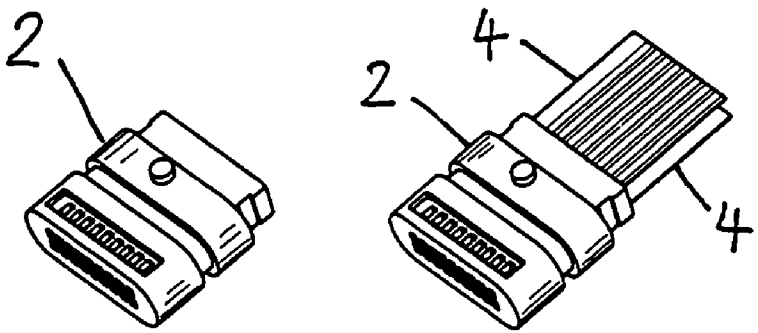
FIG.2A
FIG.2B
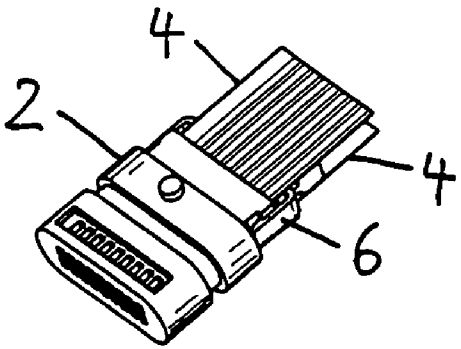
FIG.2C
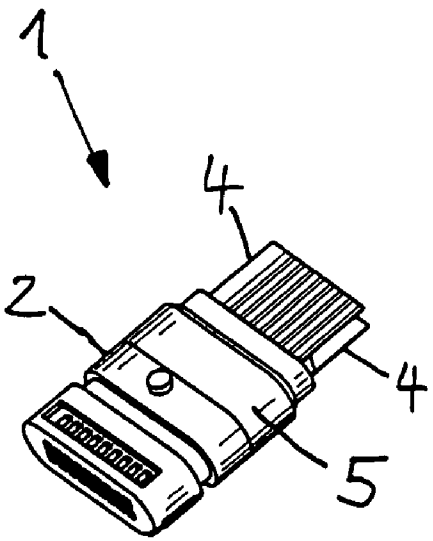
FIG.2D

MULTICONDUCTOR FLAT RIBBON CABLE PLUG CONNECTOR

FIELD OF THE INVENTION

The invention relates to a plug connector, preferably for use in automobiles with at least one contact that is fixable in a prefabricated housing and that is arranged at the end of a ribbon cable and electrically contacted to it, the housing being surrounded by an injection-molded plastic in the area where the ribbon cable enters the housing.

BACKGROUND OF THE INVENTION

From EP 1 122 840 A1 plug connectors, especially plugs or sockets, are known that have a prefabricated housing. This prefabricated housing consists of an electrically non-conductive material and is fabricated for example in a plastic injection-molding procedure. This housing has contact chambers in which contacts (e.g. contact pins or contact sleeves) can be inserted and fixed. The contacts are located at the end of respective electrical conductors and are electrically connected to them. The electrical bonding of the contact to the respective electrical conductor is made preferably by a crimp connection that is advantageous with regard to contact safety and long service life especially within applications in the field of automobiles. For achieving a longitudinal impermeability to water, which is of great importance during use of such plug connectors in the field of automobiles, it is necessary that the area in which at least one electrical conductor enters the housing be sealed so that water or moisture, which are on the electrical conductors, cannot get into the contact chambers in which the contacts are situated. To this end it is provided in EP 1 122 840 that the housing can be surrounded with an injection-molding plastic in the area where at least one electrical conductor enters the housing. This way a seal is produced in an injection-molding procedure in the one end area of the plug connector so that no water or moisture can reach from the direction of the electrical conductors into the direction of the contact chambers anymore. In EP 1 122 840 A1 it is furthermore proposed that this injection-molding plastic also surrounds the contact point (crimp area), at which the contact is electrically contacted to the ends of the electrical conductors. This leads to a further increase of contact safety and a long service life. However during the molding and the processing of the injection-molding plastic it has to been noticed that this injection-molding plastic can get all the way to the contact chambers. To avoid intrusion of the injection-molding plastic into the contact chambers, the prefabricated housing, which is preassembled with the contacts and the electrical conductors, is inserted into an injection-molding tool, this tool having a slide that fits with the injection-molding tool in such a way that it prevents the injection-molding plastic from getting into the contact chambers of the housing during the molding process. Such a slide has to be manufactured individually for every housing type, so that the tool cost is high. In addition for every housing type it is necessary to provide a slide adapted to it on the injection-molding tool, so that only one style of plug connector can be manufactured by each injection-molding tool.

Furthermore it is necessary in EP 1 122 840 that the electrical conductors, which can be e.g. flexible strands or wires with an insulating coating, have to be inserted in a given arrangement into the injection-molding tool. This is necessary so that the injection-molding plastic can effectively form the seal. Up to now these electrical conductors were clamped together, so an over-injection in the outgoing area, that is at the transition area between the prefabricated housing into the direction of the electrical conductors, can be caused by the resulting gussets during the clamping together. During movements of the plug connection, which are typical in an application in the field of automobiles because of vibrations, damage is caused to the electrical conductors by these resulting gussets, so that a continuous electrical contact is no longer securely guaranteed. Furthermore, the molding and the processing (the extrusion process) is problematic depending on the type of electrical conductor. This means that in implementations with a common clamping the length of the injection-molding plastic (extrusion length) has to be extended, because the area where the single electrical conductors lie on top of each other cannot be used as extrusion length for the sealing.

Besides it is state of the art (DE 10 2005 009 441 from Feb. 2, 2005, see FIG. 5 of this patent application), that a slide is provided that can be inserted into the prefabricated housing before the beginning of the injection-molding process and that prevents intrusion of the injection-molding plastic into the contact area of the at least one contact, this slide not forming a part of an injection-molding tool for the molding and processing of the injection-molding plastic. This effectively prevents on single-row or multi-row plug connectors that the injection-molding plastic can intrude into the front contact area of the housing, that is in the direction of the contact chambers, and simultaneously the contact area, that is the area in which the electrical conductors are electrically contacted to the contacts, can still be effectively sealed. On double-row or multi-row plug connectors the slide is inserted between both the contact rows or between the several contact rows for achieving a sufficient seal. This way the lateral slide known so far can be given up in an injection-molding tool because of the existence and the insertion of the slide into the prefabricated housing. Furthermore it is provided that an element is used that fixes several electrical conductors in a given position relative to each other, this element being surrounded at least partially, especially completely, by the injection-molding plastic. This element has the task of positioning the several electrical conductors in a given position relative to each other, so that over-injections into the outgoing area can be prevented by it. What is more, the extrusion length can be reduced by the element according to the invention due to the positioning of the single electrical conductors relative to each other with a common clamping. Such an element is a possibility with single-row plug connectors, when the electrical conductors are flexible strands or cables or such, that is single conductors. However the one-piece element consisting of slide and strand casing has the disadvantage that it is complexly formed and can thus lead to difficulties during assembly, especially during insertion into the injection-molding tool. Besides it is necessary to remove the spacer, which holds the slide and the fixing element together before and during the injection process, after the injection-molding process, so that it does not stick out of the finished plug connector. Furthermore the slide only serves to seal the contact chamber against the injection-molding plastic, which is already satisfactorily solved with this implementation. However there is no satisfactory solution yet concerning the fixing of the electrical conductor inside the housing of the plug connector, because the slide has only a seal function and no fixing function and the element for fixing of the electrical conductors is arranged at the end of the housing, that is outside the housing of the plug connectors.

OBJECT OF THE INVENTION

Therefore an object of the invention is to avoid the disadvantages described above, especially to simplify the injection-molding process while taking into consideration the tolerances of ribbon cables and to this way maintain or even increase the seal effectiveness concerning the longitudinal impermeability to water.

SUMMARY OF THE INVENTION

According to the invention a spacer that can be inserted into the prefabricated housing of the plug connector is provided that prevents intrusion of the injection-molding plastic into a contact area of the at least one contact, the spacer having at least one recess that can be filled with the injection-molding plastic and pressing the ribbon cable against the inner surface of the housing. On the one hand the spacer takes over, as already known, the seal function for the injection-molding plastic against the contact area of the contact. On the other hand it also takes over the function of fixation of the ribbon cable, especially of two ribbon cables arranged parallel to each other (more than two are possible) inside the housing of the plug connector, for which it is formed such that after the insertion of the at least one ribbon cable (in the area that borders the contacts) this area of the ribbon cable is pressed against the inner surface of the housing to achieve a first fixation in position. This has the further advantage that tolerances in the thickness of the ribbon cables can be compensated out. For achieving longitudinal impermeability to water and for the compensation of further tolerances the spacer has at least one recess that can be filled with injection-molding plastic, this at least one recess being empty before the injection-molding process and the injection-molding tool as well as the spacer with the recess and the housing of the plug connector being formed such that the injection-molding plastic can reach into the recess during the injection-molding process and this recess can be filled completely with injection-molding plastic. In case after insertion of the end of the ribbon cable with the contacts attached to it in the end area of the ribbon cable tolerances ("air") still remain between the surface of the ribbon cable and the inner surface of the housing, this area will be filled then with injection-molding plastic that, because of the recess in the spacer, has the required thickness to be long-time stable and to guarantee the required longitudinal impermeability to water. This manufacturing process produces a plug connector that is longitudinally impermeable to water and that can be fabricated a simple manner and with which tolerances can be compensated in the manufacturing process that can result from the manufacturing of the housing and which the ribbon cable has. Tolerances variations in ribbon cables normally result from the fact that they have a casing of electrically nonconductive material, on which several flat electrical wires that run parallel to each other are coated, these again being covered by a protective layer. This way elevations and intervening depressions are created in the area of the electrical conductors that could not be compensated by the slide or the element for fixation of the conductors known so far. These tolerances or high and low points are completely covered with the injection-molding plastic by way of the filling of the recess with the injection-molding plastic according to the invention, so that this way the required longitudinal impermeability to water results. With that the spacer remains in the housing after the processing of the injection-molding plastic as an advantageous embodiment of the invention. This way a fixed and compact unit of the plug connector results that can stand the mechanical stresses.

BRIEF DESCRIPTION OF THE DRAWING

Embodiments of the invention that are, however, not limiting are described in the following and explained with reference to the figures. Therein:

FIG. 2 is an assembly sequence of a plug connector that is formed as a sleeve, according to FIG. 1;

SPECIFIC DESCRIPTION

Figure 1:
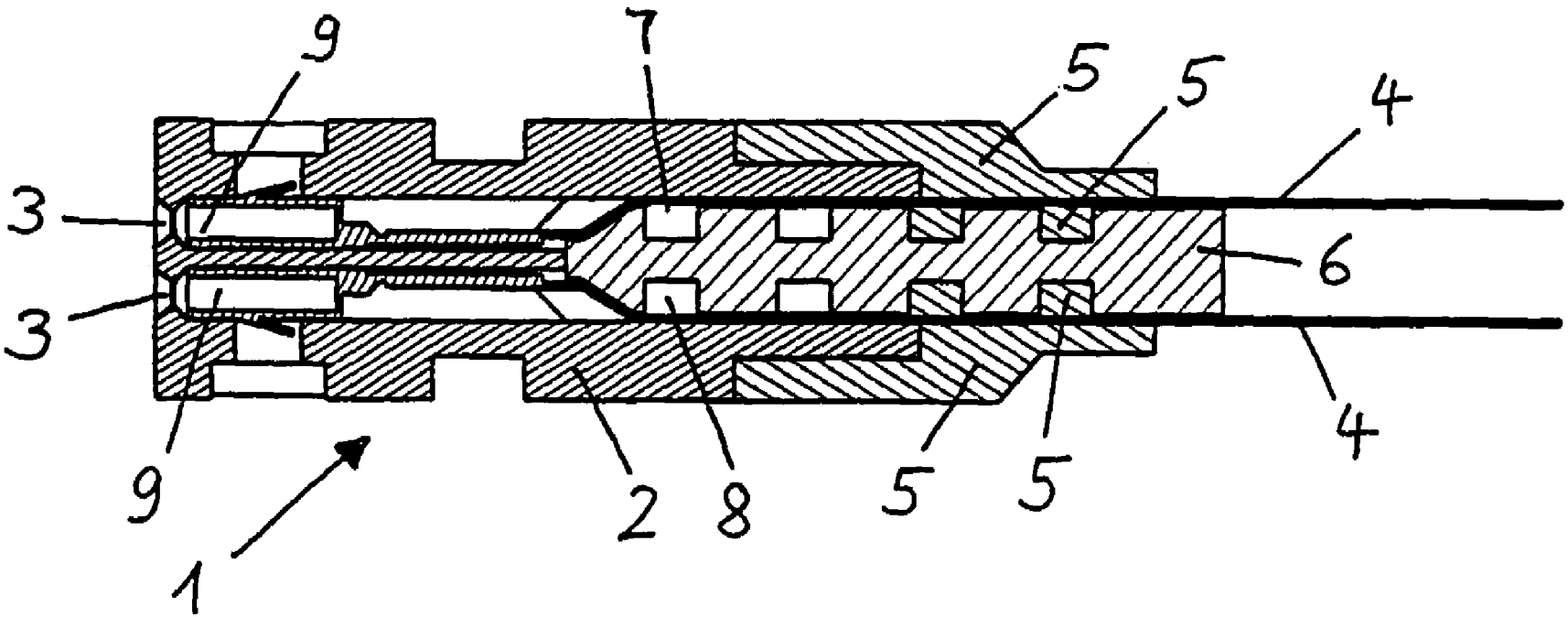
FIG. 1 is a plug connector with a spacer according to the invention.

FIG. 1 shows a plug connector with a spacer according to the invention, the plug connector 1 having a housing 2. The housing 2 has one or preferably several contact chambers 3, the end area of the plug connector 1 holding at least one flat electrical wire 4, in this embodiment two ribbon cables 4, that run parallel to each other. The assembly of such ribbon cables with support layers is known, on which are imbedded a plurality of flat electrical wires that run parallel to each other, covered by a protective layer. Plastic 5 is injected into the end area of the plug connector 1, starting from the end area of the housing 2 after the housing 2 with the assembled ribbon cables 4 is fitted into an injection-molding tool. Before the actual injection-molding process the ribbon cable 4 is fixed in position by a spacer 6 according to the invention in the inner area of the housing 2 such that the ribbon cable 4 is fitted tightly preferably with the support layer pressed against the interior surface of the housing 2. The spacer 6 has at least one recess 7 that can be filled with injection-molding plastic during the injection-molding process. The spacer 6, which can also be manufactured in an advantageous way in an injection-molding procedure, is positioned centrally symmetrically: in this embodiment, so that its recesses 7 and 8 are symmetrical to each other. Here several recesses 7 and 8 are spaced longitudinally in a row, so that some of the recesses (especially the recesses in front) are not filled with the injection-molding plastic and the recesses in the back are filled with the injection-molding plastic 5. To guarantee that the recesses 7 and 8 are completely filled with the injection-molding plastic 5 during the injection process, at least one of the recesses, preferably all recesses 7 and 8, are formed annular. This ensures that, after fitting the housing 2 with the assembled ribbon cables 4, the injection-molding plastic 5 can reach into the recesses 7 and 8 and can fill them out completely. Furthermore FIG. 1 shows that the prefabricated spacer 6 in the end area of the plug connector protrudes from the later installed injection-molding plastic 5 that solidifies after the injection-molding process. It is also possible that the end of the spacer 6 together with the end of the solidified injection-molding plastic 5 is flush or recessed. At this point it should be mentioned that it is particularly important that the recesses 7 and 8 extend nearly perpendicular or at least at an acute angle across the longitudinally extending electrical conductors of the ribbon cable 4, so that the high and low points are compensated for. Besides it is possible to insert more than one spacer 6, in fact a spacer between both ribbon cables 4 and a further spacer each between every ribbon cable 4 and the inner surface of the housing 2. This is also particularly effective when the support layer of the ribbon cable 4 has high and low spots. When one is sure that the support layer of the ribbon cable is almost plane-parallel and only the cover layer of the ribbon cable 4 has elevations or depressions respectively, one single spacer 6 is sufficient as shown in FIG. 1. In this case the longitudinal impermeability to water is also guaranteed because the ribbon cables 4 are covered completely from top and from down below is by the injection-molding plastic 5 and with it one gets compensation of tolerances at the high and low points. The contacts, e.g. contact pins, sleeves or the like that can be inserted into the contact chambers 3, are indicated with the reference numeral 9. The contacts 9 are inserted into the contact chambers 3 from the top and/or from down below and/or from the front and/or from behind and locked at least once. This is done for instance by means of a locking clip that projects from one of the contacts 9 and which, after insertion of the contact 9 into the contact chamber 3, engages there in a recess in the housing 2. In addition to this so called primary locking at least one further, so called secondary locking can be provided if necessary.

FIG. 2 shows an assembly sequence of an plug connector 1 that is formed as a sleeve (also called coupling), according to FIG. 1. From the left to the right FIG. 2 has the prefabricated housing 2 (sleeve housing), wherein in the next view the sleeve housing is fitted with a foil. This means that the contacts 9 are mounted on the end of the ribbon cables 4 that is then inserted into the housing 2. Afterward the spacer 6 is inserted into the housing 2 such that the contact chambers 3 are sealed against the injection-molding plastic brought in later and the ribbon cables 4 are pressed against the inner surface of the housing 2. The term "pressed against the inner surface" is not to be understood in the sense that the ribbon cable 4 fits in wide surface contact and under pressure to the inner surface of the housing 2. It is only important that both ribbon cables 4 (or just one ribbon cable 4) are held in the area of the housing 2 which is open to the back. Fitting of the ribbon cable 4 under substantial pressure or in wide surface contact to the inner surface of the housing 2 is not required with the present invention, since the at least one ribbon cable 4 is surrounded completely by the injection-molding plastic 5 due to the at least one recess 7 (and additionally the recess 8 with a second ribbon cable) in the spacer 6, so that the actual seal function occurs in the rear area of the spacer 6 (that is in the area of the injection-molding plastic 5) and does not take place in the inner area of the housing 2. The last view of the FIG. 2 (on the very right side) has the finished plug connector 1 formed as a coupling. In this case it is apparent that the solidified injection-molding plastic 5 has connected inside with the housing 2 and therefore forms a one-piece unit, that is the coupling where both ribbon cables 4 project hermetically from the plug connector 1 to the rear.

Figure 3:
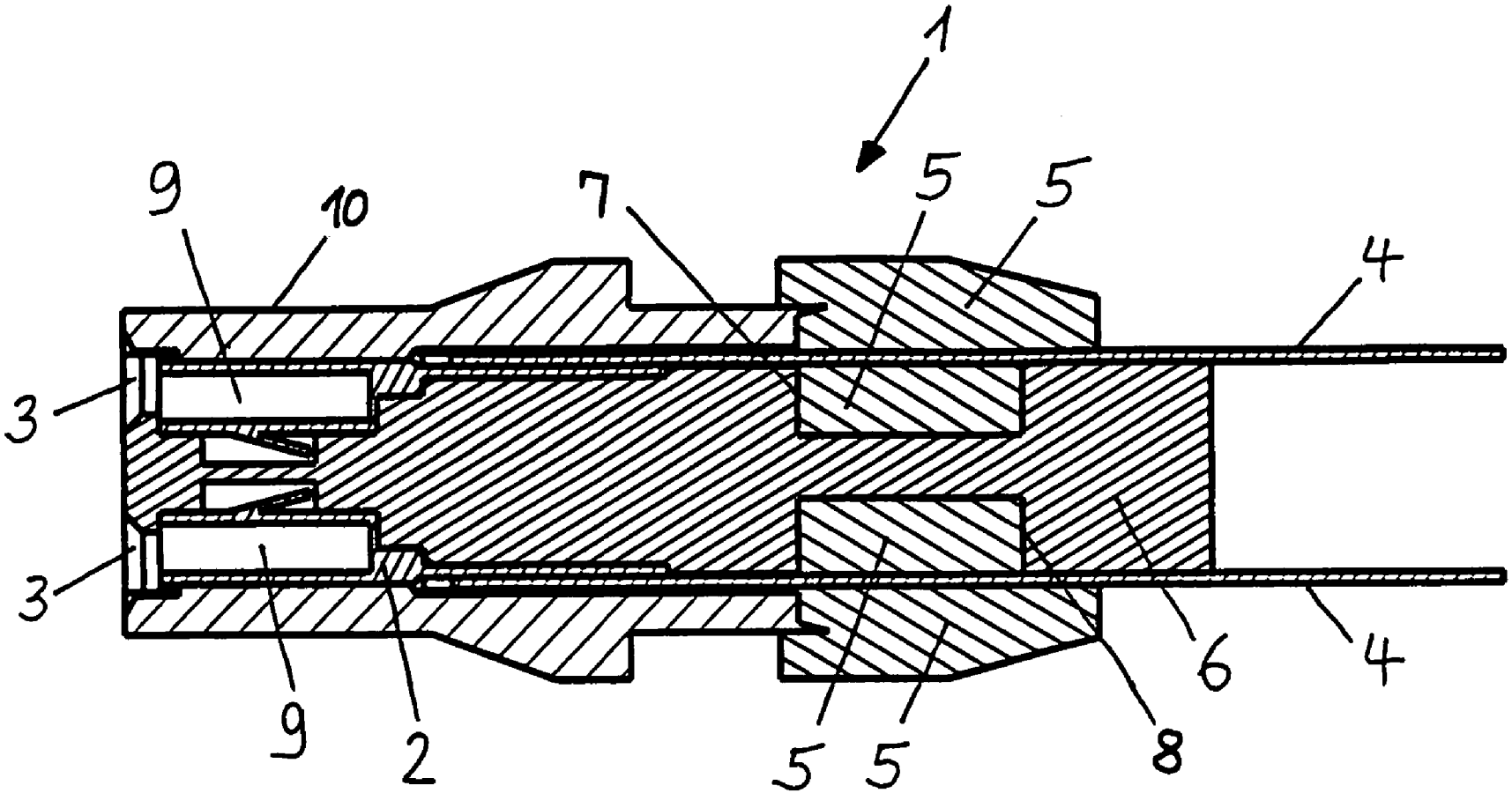
FIG. 3 is a plug connector with a spacer according to the invention, the housing being formed as a sleeve holder with a cover.
Figure 4A:
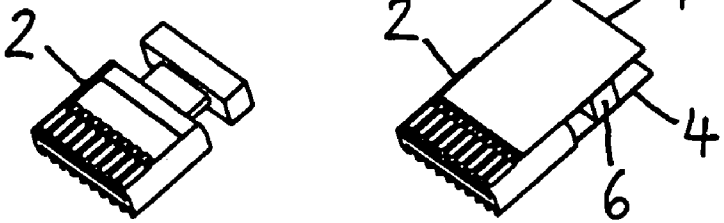
FIG. 4 is an assembly sequence of a plug connector that is formed as a sleeve, according to FIG. 3.
Figure 4B:
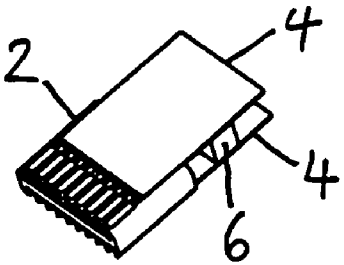
Figure 4C:
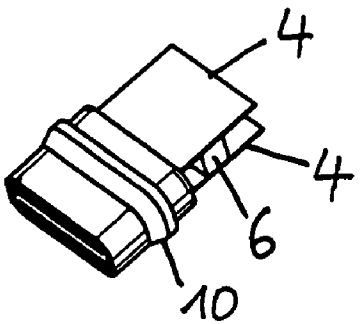
Figure 4D:
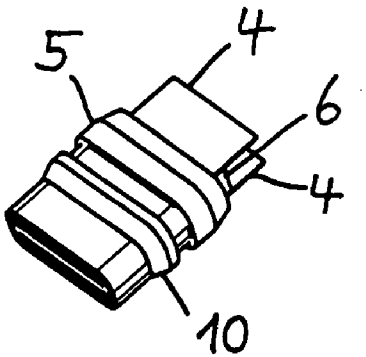

FIG. 3 has a plug connector with a spacer according to the invention, wherein the housing is formed as a sleeve holder with a cover. The structure shown in FIG. 3 resembles the structure of the plug connector according to FIG. 1, but here the housing 2 is not one piece but consists of two parts, that is a sleeve holder and a cover. This means that the housing 2, formed as a sleeve holder, is open so as to be easier to fit with the flat electrical cables 4 and with the contacts 9 arranged at their ends. In this case the contact chambers 3 of the housing 2 are initially open, so that the contacts 9 can be fitted in without further ado from above or from below and not in the longitudinal direction of the ribbon cable 4. After fitting together, a prefabricated cover 10 is pushed over the open housing 2, so that this assembly is comparable with the prefabricated closed housing 2 according to FIG. 1. In this regard FIG. 3 merely offers an alternative embodiment of the housing 2 that simplifies assembly of the contact chambers 3 with the contacts 9. The use and design as well as: the function of the spacer 6 remain the same as already described for FIG. 1. This is also seen in FIG. 3, in which the ribbon cables 4 as well as the spacer 6 with its recesses 7 and 8 are inserted into finished the housing assembly 2, 10. After this assembly process the prefabricated housing 2 is inserted into the injection-molding tool and is filled with the injection-molding plastic 5, the injection-molding plastic 5 surrounding the rear projecting area of the housing 2, 10 as well as filling out the recesses 7 and 8, so that the ribbon cable 4 is surrounded over the entire top and bottom surface as well as at the thin lateral edges with the injection-molding plastic 5 for longitudinal impermeability to water.

FIG. 4 has the assembly sequence of a plug connector that is formed as a sleeve as in FIG. 3. As already described in FIG. 3, the housing 2 consists of a sleeve holder (view at the far left), where the contact chambers of the sleeve holder are open upward and downward. The end area of the ribbon cable 4 with the contacts 9 fitted to it is inserted into these contact chambers 3 (next view of the FIG. 4) and the spacer 6 is fitted in place. Then the cover 10 (which can preferably also be manufactured in a separate injection-molding procedure) is pushed over the sleeve holder 2 so that a finished housing 2 is produced from the sleeve holder with the cover 10 assembled especially from the front (analog to the housing 2 as shown in the left view of the FIG. 2). The structure shown in the second view from the right of FIG. 4 is then inserted into an injection-molding tool that is filled with the injection-molding plastic 5. After solidifying of the injection-molding plastic 5 and after the removal from the injection-molding tool the finished coupling shown in FIG. 4 (view on the very right side) is produced.

The following points according to the invention are of interest:

Although in the description above it was always assumed that the contacts 9 are sleeves (see FIG. 2: sleeve housing, see FIG. 4: sleeve holder), it goes without saying that the contacts 9 can be formed as contact pins in which case the housing 2 has to be made as a pin housing and pin holder respectively. The spacer 6 according to the invention can be inserted into one-row, two-row as well as multiple-row plug connectors (like plugs, couplings, sleeves or the like). Finally it should be mentioned that the advantage of the spacer 6 is that it is formed such that no application of pressure (clamping) takes place in the area in which the electrical conductors of the ribbon cable 4 join the contacts 9. In one embodiment the contacts 9 longitudinally fit with the electrical conductors of the ribbon cable 4, e.g. by means of a crimp connection, such a crimp connection representing particularly well the electrical joining in a known manner, because such a joint has a high mechanical stability and is gas tight. To maintain this over a longer time period, it is important that the crimp connection be protected (to prevent corrosion) and released from mechanical stresses from the outside. Both ends are achieved by the spacer 6. Because the spacer 6 (no matter whether in the embodiment according to FIG. 1 or FIG. 3) is formed such that it performs no clamping in this crimping area, it has no mechanical effect on this crimping area. Further mechanical stresses from the outside cannot occur because the crimping area is inside the housing 2 and the cover 10. In addition the crimping area is sealed by the injection-molding plastic 5 so that no damaging effects like moisture, water or the like can reach into the crimping area. By the term "flat electrical wire" all rigid and flexible ribbon cables, especially FPC (Flexible Printed Circuit) or FFC foils are understood.

The injection-molding process (the extrusion process) is improved considerably by the spacer 6 according to the invention altogether. No clamping is necessary in the crimp area of the contacts 9. A further advantage is that, unlike the extrusion technique with a crimp clamping (as known e.g. from EP 1 122 840 A1), the crimp area in the sleeve housing (coupling housing or plug housing) is protected.

Figure 5:
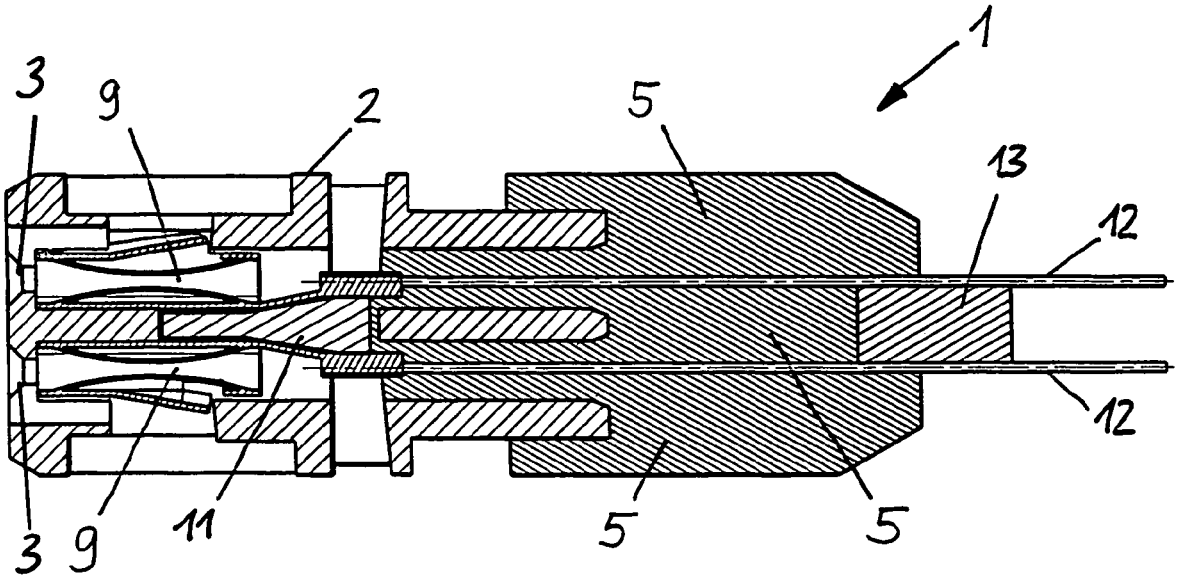
FIG. 5 is a plug connector with a slide in a sectional view according to the state of the art.

FIG. 5 has a plug connector 1 according to the state of the art with a housing 2 and contact chambers 3. Electrical conductors, formed as circular conductors, are shown at reference numeral 4. The housing 2 is provided with an injection-molding plastic 5 for the seal to the outside, a slide 11 preventing the injection-molding plastic 5 from extending into the contact chambers 3 and the therein situated contacts 9. In the end area of the plug connector 1 several electrical circular conductors 12 that are arranged beside each other and on top of each other are fixed imposition relative to one another by means of a cable guide 13. With this the shown finished plug connector 1 has the injection-molding plastic 5 as a seal, the slide 11 having prevented the injection-molding plastic 5 from getting into the contact chambers 3 and therefore into the contact area of the contacts 9. Likewise the element 7 for fixation of the electrical circular conductors 12 to each other is available.

The invention claimed is:

1. In combination with a multiconductor flat ribbon cable, a connector comprising:

a longitudinally rearwardly open housing having a forwardly open contact chamber, the cable projecting longitudinally forward in the housing into the contact chamber;

respective contacts in the contact chamber connected to conductors of the cable;

a spacer having a portion extending longitudinally forward into the housing in direct contact with the ribbon cable and a portion projecting longitudinally rearward from the housing, the spacer being formed with at least one transversely extending open recess on the portion inside the housing, wherein the transverse recess is outward toward the ribbon cable; and a molded synthetic-resin mass engaged around the cable immediately rearward of the housing, filling the recess, and bearing transversely outward against the cable.

2. The combination defined in claim 1 wherein the spacer has a plurality of the recesses and at least one of the recesses is wholly inside the housing.

3. The combination defined in claim 1 wherein the mass is bonded to a rear end of the housing by being molded thereto.

4. The combination defined in claim 1 wherein the housing is formed of an inner part and a sleeve-like outer part.

5. The combination defined in claim 1 wherein the spacer is plastic.

6. The combination defined in claim 1 wherein the ribbon cable an outer face bearing on an inner surface of the housing and an inner face engaged by the mass in the recess.

7. The combination defined in claim 1 further comprising a second such multiconductor flat cable parallel to the first-mentioned cable;

second such respective contacts in the contact chamber separate from the first-mentioned contacts and connected to the conductors of the second cable, the spacer being formed with a second such transversely extending recess open inside the housing toward the second cable, the mass also filling the second recess and bearing transversely outward against the second cable.

8. The combination defined in claim 7 wherein the recesses are symmetrical to each other.

9. The combination defined in claim 7 wherein the spacer has a plurality of the first-mentioned recesses spaced longitudinally from one another and a plurality of the second-mentioned recesses also spaced longitudinally from one another.

* * * * *